United States Patent [19]

Liljekvist et al.

[11] 4,274,496

[45] Jun. 23, 1981

[54] METHOD AND DEVICE IN EARTH CUTTING

[75] Inventors: Bernt S. Liljekvist; Anders E. Persson, both of Sandviken, Sweden

[73] Assignee: Sandvik Aktiebolag, Sandviken, Sweden

[21] Appl. No.: 114,339

[22] Filed: Jan. 23, 1980

[30] Foreign Application Priority Data

Feb. 2, 1979 [SE] Sweden ..... 7900922

[51] Int. Cl.[3] ..... E21B 10/16; E21B 10/20; E21B 10/28

[52] U.S. Cl. ..... 175/57; 175/53; 175/344; 175/376

[58] Field of Search ..... 175/53, 57, 344, 342, 175/376

[56] References Cited

U.S. PATENT DOCUMENTS

| | | | |
|---|---|---|---|
| 3,203,492 | 8/1965 | Lichte | 175/334 X |
| 3,612,197 | 10/1971 | Motoyama | 175/374 X |
| 3,659,659 | 5/1972 | Lichte | 175/53 |
| 3,659,660 | 5/1972 | Conn | 175/53 |
| 3,726,350 | 4/1973 | Pessier | 175/374 |
| 3,805,901 | 4/1974 | Coski | 175/53 |
| 3,858,667 | 1/1975 | Goodfellow | 175/53 |

FOREIGN PATENT DOCUMENTS 1805336 5/1970 Fed. Rep. of Germany .

*Primary Examiner*—Stephen J. Novosad
*Attorney, Agent, or Firm*—Burns, Doane, Swecker & Mathis

[57] ABSTRACT

A bore head for reaming a pre-drilled hole in raise boring or for similar earth cutting operations comprising at least two sets of roller cutters. The roller cutters in the same set of cutters have the same number of rows of cutting means. The roller cutters are mounted in pairs on each side of the rotational axis of the bore head. During rotation of the bore head the cutting means move along concentric circles. In order to change the distance between two consecutive circles a roller cutter in one of the pairs of cutters is replaced by a roller cutter of the other set of cutters.

7 Claims, 6 Drawing Figures

METHOD AND DEVICE IN EARTH CUTTING

The invention relates to a method of varying the row distance on a boring head and a boring head for carrying out the method. The boring head has mounting means for a plurality of roller cutters, which each has a plurality of rows of cutting means, such as hard metal inserts. The rows extend circumferentially around the roller cutters and are mutually displaced in the axial direction thereof. The boring head comprises at least a first and a second set of roller cutters. In each set all the roller cutters have the same number of cutting means. The number of rows of cutting means on a roller cutter in the first set of cutters is at least as large as the number of rows of cutting means on a roller cutter in the second set.

The invention relates generally to earth boring, but is particularly intended for raise boring. In raise boring a pilot hole is drilled between a lower level and an upper level in a mine, whereupon the pilot hole is enlarged by means of a reaming head having a large diameter.

During boring by means of such a boring head the hardness of the rock varies between different bore holes. It is an object of the invention to set forth a method and device for earth cutting in which a drilling rate as high as possible is obtained regardless of the hardness of the rock formation. This means that a row distance should be used when softer rock formations are disintegrated, which is larger than the suitable row distance when harder rock formations are disintegrated.

The prior art is in general represented by U.S. Pat. No. 3,805,901. In the boring head shown in this patent, however, the row distance remains unchanged regardless of how the two types of roller cutters are placed on the boring head.

In German OS No. 1,805,336 there is shown a boring head, wherein the row distance is changed with regard to the hardness of the rock formation. In this previously known boring head, however, each of the roller cutters in one set of cutters is not selectively replaceable by each of the roller cutters in the other set. The roller cutters are mounted on a plurality of radially extending supporting arms. The row distance is changed by removing a whole unit comprising a supporting arm and the roller cutters mounted thereon. Further, in this boring head all roller cutters are identical. This means that if the technique suggested in German OS No. 1,805,336 is applied in a boring head having selectively replaceable roller cutters, i.e. a boring head of the type shown in U.S. Pat. No. 3,805,901, the row distance would be varied by decreasing or increasing the number of roller cutters.

Another object of the invention is to make possible a variation of the row distance without having to change the type of roller cutters on the boring head or the overall number of roller cutters.

A further object of the invention is to maintain unchanged the feeding force applied on each row of cutting means on the roller cutters when the row distance is varied. Preferably, the overall feeding force applied on the boring head is the highest possible feeding force which the earth cutting machine can produce.

The above and other objects of the invention are attained by giving the invention the characterizing features stated in the claims following hereinafter.

The invention is described in detail below with reference to the accompanying drawings in which one embodiment of the invention is shown by way of example. It is to be understood that this embodiment is only illustrative of the invention and that various modifications thereof may be made within the scope of the claims following hereinafter.

In the drawings

Figure 1:
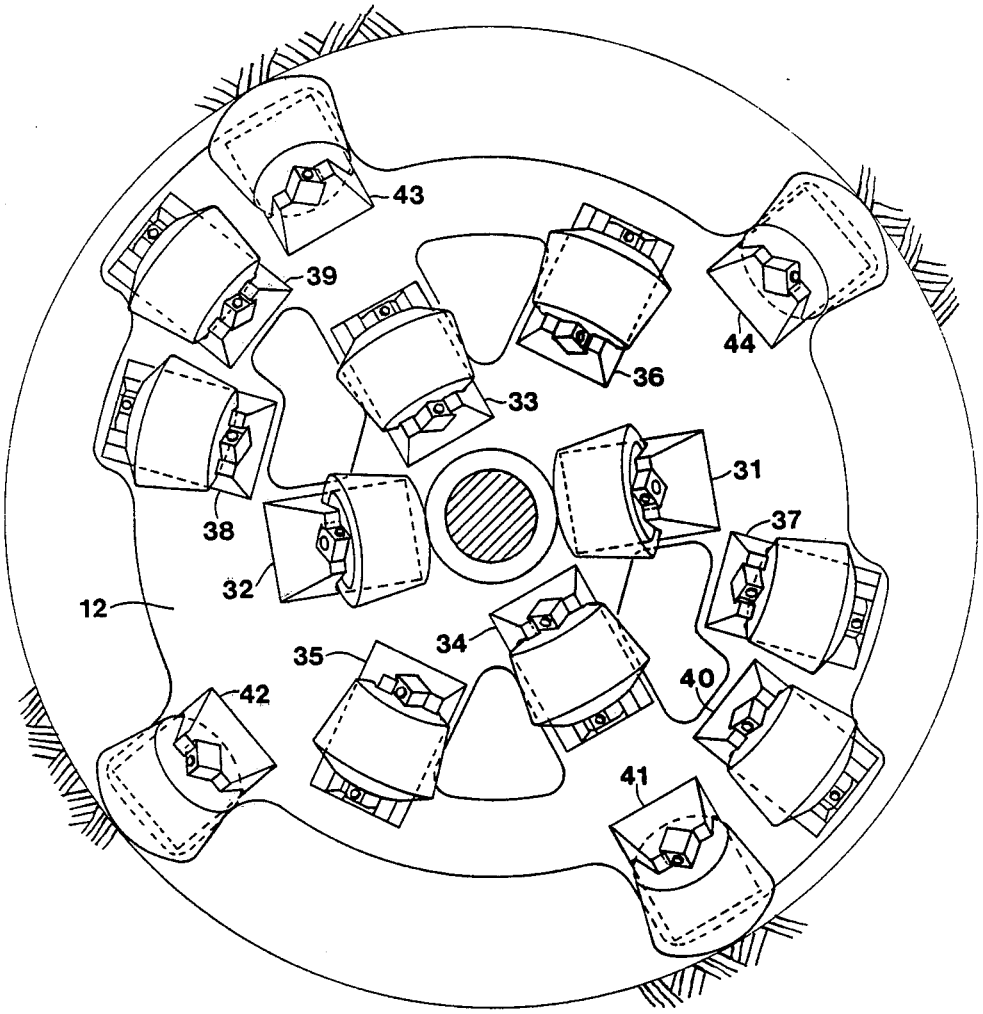
FIG. 1 is a plan view of a boring head according to the invention.
Figure 2:
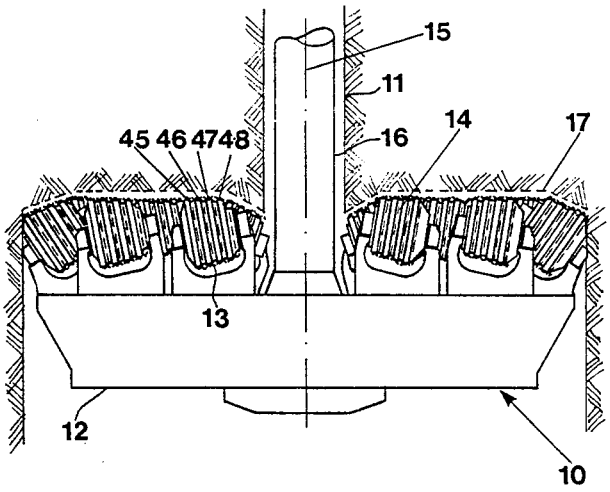
FIG. 2 is an elevational view of the boring head in FIG. 1, in which several of the roller cutters are rotated from their positions according to the patterned array of FIG. 1 and superimposed upon one another to illustrate the face-engaging position each roller cutter assumes upon rotation of the boring head.
Figure 3:
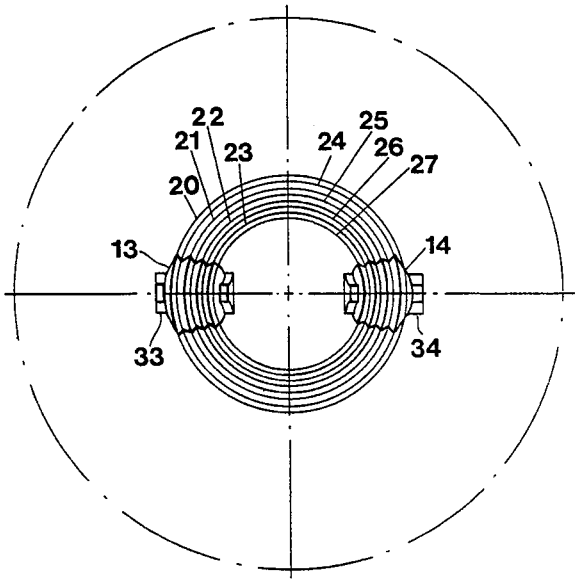
FIG. 3 is a top view of the boring head in FIG. 2; for the sake of clarity, however, only two roller cutters are shown together with the circles along which the cutting means on these roller cutters move during the rotation of the boring head.
Figure 4:
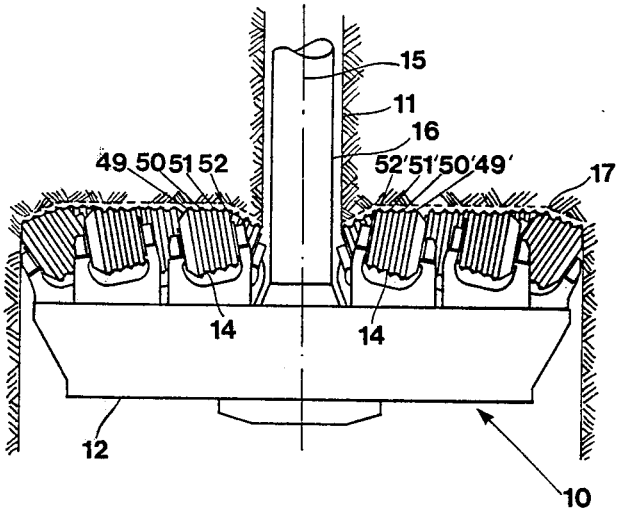
Figure 5:
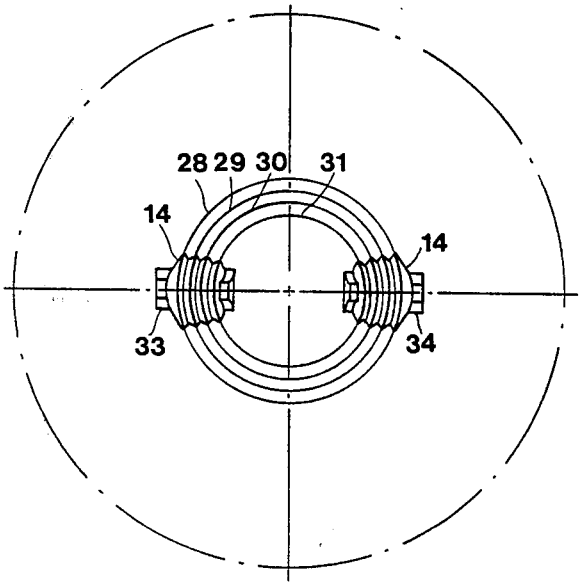

FIGS. 4 and 5, which correspond to FIGS. 2 and 3, show the boring head having a large row distance.

Figure 6:
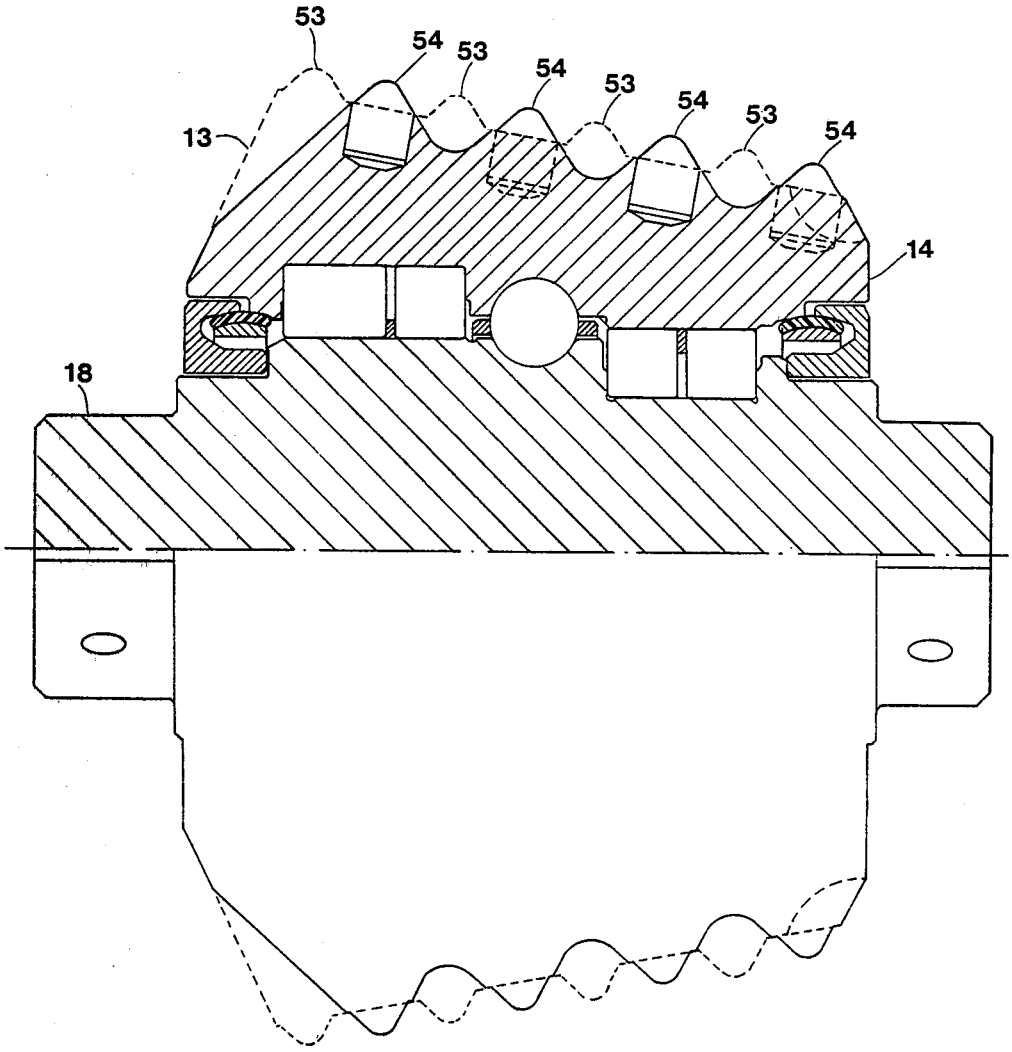

FIG. 6 shows, partly in section, a roller cutter of one set of cutters, and the contourlines of a roller cutter of another set of cutters.

In the drawings, a pilot hole 11 pre-drilled in conventional manner between an upper level and a lower level, not shown, in a mine is reamed by means of a boring head generally depicted by the reference numeral 10. The boring head 10 comprises a body 12 on which a plurality of roller cutters 13, (in the illustrated embodiment fourteen cutters are provided) are mounted in mounting means or saddles 31–44. A rotary drive stem 16 is attached to the body 12. The boring head 10 is rotated and forced against an annular surface 17 surrounding the pilot hole 11 by means of the stem 16.

The saddles 31–44 are mounted in diametrically opposed pairs on each side of the rotational axis 15 of the boring head 10 and at the same distance from the axis 15. The roller cutters 13, 14 are rotatably journalled in the saddles 31–44 by means of a shaft 18, FIG. 6. In a manner known per se, the innermost pair of roller cutters in the saddles 31, 32 are positioned in such a way that their shafts 18 are at an acute angle to the rotational axis 15, the two outermost pairs of roller cutters in the saddles 41, 43 and 42, 44, respectively, are positioned in such a way that their shafts 18 are at an obtuse angle to the axis 15, and the intermediate pairs of roller cutters in the saddles 33–40 are positioned in such a way that their shafts 18 are at angles to the axis 15 varying between these limits such that a generally convex cutting surface 17 is produced.

In the illustrated embodiment, the boring head 10 comprises two sets of roller cutters 13, 14. A roller cutter 13 of the first set has cutting means 53 in form of hard metal inserts which are fitted in bores in the body of the roller cutter. The inserts 53 are positioned in rows 45–48 which extend circumferentially around the roller cutter. The rows 45–48 are mutually displaced in the longitudinal direction of the roller cutter. A roller cutter 14 of the second set of cutters has in similar manner cutting means 54 positioned in rows 49–52. All the roller cutters in one and the same set of cutters have the same number of rows of cutting means.

During rotation of the boring head 10 the cutting means 53, 54 on the roller cutters 13, 14 will move along concentric circles when making their cuts. For the sake of clarity only those circles are shown in FIGS. 3 and 5 along which the cutting means on the roller cutters in one of the pair of saddles 33, 34 move.

The cutting means 53 on the roller cutter 13 mounted in the saddle 33, see FIG. 3, move along circles 20–23. The cutting means 54 on the roller cutter 14 mounted in the saddle 33, see FIG. 5, move along circles 28–31. As shown in FIG. 6, the cutting means 54 on the roller cutters 14 are located between the cutting means 53 on the roller cutters 13 with respect to the axis of the shafts 18. Since the shafts 18 of the roller cutters 13, 14 are identical, this means that the radii of the circles 20–23 are different from the radii of the circles 28–31.

In order to obtain the smaller row distance in the illustrated embodiment, see FIGS. 2 and 3, roller cutters 13 of the one set of cutters are mounted in the saddles 31, 33, 35, 37, 39, 41 and 43. Roller cutters 14 of the other set of cutters are mounted in the saddles 32, 34, 36, 38, 40, 42 and 44. Thus, a roller cutter from each set of cutters is mounted in each pair of saddles. According to the invention the rows of cutting means are positioned on the roller cutters 13, 14 in such a way that a circle, for instance the circle denoted by 21, along which one of the rows of cutting means on the roller cutter 13 moves is substantially half-way between two consecutive circles, in this case the circles denoted by 24 and 25, along which the rows of cutting means on the roller cutter 14 move. Due to the fact that all the saddles are positioned in pairs at the same distance from the rotational axis 15, circles are produced for all the pairs of saddles during rotation of the boring head 10 which circles are positioned in mutually similar manner.

In order to obtain the larger row distance in the illustrated embodiment, see FIGS. 4 and 5, roller cutters 13 are mounted in the saddles 39, 40, 41, 42, 43 and 44. Roller cutters 14 are mounted in the saddles 31, 32, 33, 34, 35, 36, 37 and 38. In each pair of saddles, thus, a roller cutter of one and the same set of cutters is mounted. This means that two rows of cutting means, for instance the cutting means 49–52 and 49'–52' on the roller cutters 14, 14 in FIG. 5, will move along the same circles.

When the row distance is to be increased, and thus the overall number of concentric circles are to be decreased along which the cutting means on the boring head 10 move during the rotation of the head 10, then roller cutters 13 mounted in the saddles 31, 33, 35 and 37 are replaced by roller cutters 14. At the same time roller cutters 14 mounted in the saddles 40, 42 and 44 are replaced by roller cutters 13. When the row distance is to be decreased, the one of two cutters of the same set of cutters, for instance of type 14 in the saddles 33, 34, is replaced by a roller cutter of the other set of cutters, in this case a roller cutter of type 13.

According to the invention the number of the rows of cutting means on the roller cutters 13, 14 are the same. This means that the forces acting on the boring head 10 are balanced if roller cutters of the same as well as of different sets of cutters are mounted in one of the pair of saddles. By suitably chosing the patterned array of roller cutters on the boring head 10, however, it is possible to satisfactorily balance the forces acting on the boring head even if the number of rows of cutting means on the roller cutter 13 are larger than the number of rows of cutting means on the roller cutters 14.

We claim:

1. A method of varying the distance between circular cuts made by a boring head of the type rotatable about a first axis and comprising a plurality of roller cutters, each cutter having a plurality of circumferentially extending rows of cutting means, which rows are spaced along a second axis of rotation of said cutter, and a plurality of mounting means arranged in pairs, the mounting means of each pair being located on opposite sides of said first axis and at the same distance therefrom, said cutters being interchangeable in said mounting means, said method comprising the steps of:

providing said roller cutters in the form of different first and second sets of roller cutters, each roller cutter in a set having the same number of rows of cutting means as the other roller cutters of such set, and the number of rows of cutting means on one cutter of said first set being at least as great as the number of rows of cutting means on one cutter of said second set, and selectively interchanging cutters of said first and second sets relative to at least a first pair of mounting means between first and second modes of operation whereby:

in said first mode said one cutter of said first set and said one cutter of said second set are mounted in said first pair of mounting means so that at least one row of cutting means of said one cutter of said first set makes a circular cut having a radius different than the radii of circular cuts made by the rows of cutting means of said one cutter of said second set, and in said second mode two cutters of the same set are mounted in said first pair of mounting means so that at least one row of cutting means of one of said two cutters makes a circular cut having a radius equal to the radius of a circular cut made by a row of cutting means of the other of said two cutters.

2. A method according to claim 1, wherein in said second mode all of the rows of cutter means of one of said two cutters makes circular cuts having radii equal to the radii of circular cuts made by the rows of cutter means of the other of said two cutters.

3. A method according to claim 1, wherein in said first mode all rows of cutter means of said one cutter of said first set makes circular cuts having radii different than the radii of circular cuts made by the rows of cutter means of said one cutter of said second set.

4. A method according to claim 1, wherein in said first mode a cutter of said first set and a cutter of said second set are mounted in more than one pair of mounting means; and in said second mode two cutters of the same set are mounted in more than one pair of mounting means.

5. In a boring head of the type rotatable about a first axis and comprising a plurality of roller cutters, each cutter having a plurality of circumferentially extending rows of cutting means, which rows are spaced along a second axis of rotation of said cutter, and a plurality of mounting means arranged in pairs, the mounting means of each pair being located on opposite sides of said first axis and at the same distance therefrom, said cutters being interchangeable in said mounting means, the improvement wherein:

said roller cutters comprise different first and second sets of roller cutters, each roller cutter in a set having the same number of rows of cutting means as the other roller cutters of such set, and the number of rows of cutting means on one cutter of said first set being at least as great as the number of rows of cutting means on one cutter of said second set, said cutters of said first and second sets being selectively interchangeable relative to at least a first pair of mounting means between first and second modes of operation, in said first mode said one cutter of said first set and said one cutter of said second set being mounted in said first pair of mounting means so that at least one row of cutting means of said one cutter of said first set makes a circular cut having a radius different than the radii of circular cuts made by the rows of cutting means of said one cutter of said second set, and in said second mode two cutters of the same set are mounted in said first pair of mounting means so that at least one row of cutting means of one of said two cutters makes a circular cut having a radius equal to the radius of a circular cut made by a row of cutting means of the other of said two cutters.

6. A boring head according to claim 5, wherein the number of rows of cutting means on said first roller is equal to the number of rows of cutting means on said second cutter.

7. Apparatus according to claim 5, wherein said one cutter of said first set makes a circular cut disposed half way between adjacent circular cuts made by the rows of cutting means of said one cutter of said second set.

* * * * *